United States Patent [19]

Gunn et al.

[11] 4,204,624

[45] May 27, 1980

[54] NAILING MACHINE FOR USE IN THE MANUFACTURE OF WOODEN PALLETS

[75] Inventors: Christopher J. Gunn, Kettering; Joseph Barker, Glenfield, both of England

[73] Assignee: Whitfield Wylie Limited, Kettering, England

[21] Appl. No.: 946,549

[22] Filed: Sep. 28, 1978

[30] Foreign Application Priority Data

Oct. 1, 1977 [GB] United Kingdom ..... 40880/77

[51] Int. Cl.[2] ..... B27F 7/00

[52] U.S. Cl. ..... 227/45; 227/50; 227/101

[58] Field of Search ..... 227/44, 45, 50, 99, 227/100, 101

[56] References Cited

U.S. PATENT DOCUMENTS

| | | | |
|---|---|---|---|
| 2,224,599 | 11/1940 | Hingston | 227/45 |
| 3,706,408 | 12/1972 | Burch | 227/45 |
| 3,968,560 | 7/1976 | Vial | 227/100 X |
| 4,039,112 | 8/1977 | Schultz | 227/100 X |

*Primary Examiner*—Paul A. Bell

*Attorney, Agent, or Firm*—Scrivener, Parker, Scrivener and Clarke

[57] ABSTRACT

A nailing machine for use in the manufacture of wooden pallets made from deck boards and stringers. The machine comprises a conveyor operable to convey pallet components to a nailing station at which they are nailed together. The conveyor comprises locating means by which stringers are located on the conveyor and operation of the conveyor draws deck boards out of feeding means therefor on to the stringers for nailing thereto.

10 Claims, 8 Drawing Figures

NAILING MACHINE FOR USE IN THE MANUFACTURE OF WOODEN PALLETS

BACKGROUND OF THE INVENTION

This invention concerns a nailing machine for use in the manufacture of wooden pallets. Wooden pallets are widely used for a variety of load-bearing purposes especially where goods are to be handled by means of a fork-lift truck. One widely used type of pallet is the so-called "American" type which comprises a top deck on which goods to be handled are placed, a bottom deck, and stringers which separate the two decks and provide access between the two decks for the forks of a fork-lift truck. The top deck comprises boards extending parallel to one another transversely of the stringers and the bottom deck is similarly constructed.

At present, pallets of the American type are generally manufactured by locating the stringers with the boards to form one of the decks on top of them, feeding these boards and stringers to a nailing station of a first nailing machine, operating the first nailing machine to nail the boards to the stringers, feeding the partially-completed pallet to an inverting machine which inverts it to bring the stringers uppermost, locating boards to form the other deck on top of the stringers, feeding the partially-completed pallet to a nailing station of a second nailing machine, and operating the second nailing machine to nailing the boards to form the other deck to the stringers thereby completing the pallet. This method of manufacture involves two nailing machines, an inverting machine and feeders and, therefore, involves considerable costs in machinery and floor space.

CROSS-REFERENCE TO RELATED APPLICATION

An application for U.S. Pat. Ser. No. 946,548, filed Sept. 28, 1978 pertains to 'Improvements in Conveyor Arranged to Move Around an Endless Path', and was filed in the names of Joseph Barker and Barry C. T. Wright.

BRIEF SUMMARY OF THE INVENTION

It is an object of the present invention to provide an improved nailing machine by means of which wooden pallets can be manufactured, the machine making possible cost savings compared to some existing machines.

There is hereinafter described in detail to illustrate the invention a nailing machine which is suitable for use in the manufacture of wooden pallets of the American type. The illustrative nailing machine comprises a conveyor comprising endless chains and jigs. The jigs of the conveyor form locating means arranged to locate bottom deck boards of a pallet so that they extend longitudinally of the path of movement of the conveyor and stringers of a pallet on top of the bottom deck boards so that they extend transversely of the path of movement of the conveyor. The conveyor is operable to convey these pallet components located thereon to a nailing station of the machine.

The illustrative nailing machine also comprises feeding means in which top deck boards can be located so that they extend longitudinally of the path of movement of the conveyor. The feeding means comprises an angled table on which the top deck boards are positioned and a pushing bar by means of which the boards can be pushed off the table to the nailing station. The feeding means is operable to feed the deck boards from the angled table into position above a leading stringer on the conveyor which has been conveyed to the nailing station of the machine. The feeding means is operable to feed the deck boards from the angled table against a gate of the illustrative nailing machine at the nailing station. The gate is so positioned that, when the deck boards engage the gate, they are positioned as aforesaid above the leading stringer. The gate is mounted for movement so that after the boards have been nailed to the leading stringer, it can be moved out of the path of the boards by moving means of the illustrative nailing machine.

The illustrative nailing machine also comprises nailing means comprising a first nailing mechanism comprising upper hammer boxes and hammers thereof which are operable to nail the top deck boards from the feeding means to stringers at the nailing station from above the stringers. The nailing means of the illustrative machine also comprises a second nailing mechanism comprising lower hammer boxes and hammers thereof which are operable to nail the bottom deck boards located on the conveyor to the stringers at the nailing station from below the stringers. The first and the second nailing mechanisms are arranged to operate simultaneously on each stringer in turn.

Operation of the conveyor of the illustrative machine to move the leading stringer away from the nailing station towards an unloading station of the machine is effective to withdraw the top deck boards from the feeding means, since they are now nailed to the leading stringer, so that they are located on the following stringers for nailing thereto.

The illustrative nailing machine occupies less floor space than some known machinery for making pallets since only one machine is involved and, since it avoids the necessity for an inverting machine, reduces machinery costs.

The invention provides a nailing machine for use in the manufacture of wooden pallets comprising a conveyor operable to convey pallet components located thereon to a nailing station of the machine, the conveyor comprising locating means arranged to locate stringers of a pallet so that they extend transversely of the path of movement of the conveyor, feeding means in which deck boards of a pallet can be located so that they extend longitudinally of the path of movement of the conveyor, the feeding means being operable to feed deck boards of a pallet into position above a leading stringer which has been conveyed to the nailing station, and nailing means operable to nail deck boards to stringers at the nailing station, operation of the conveyor to move the leading stringer away from the nailing station being effective to withdraw the deck boards from the feeding means so that they are located on the following stringers for nailing thereto.

The invention also provides a nailing machine for use in the manufacture of wooden pallets comprising a conveyor operable to convey pallet components located thereon to a nailing station of the machine, the conveyor comprising locating means arranged to locate bottom deck boards of a pallet so that they extend longitudinally of the path of movement of the conveyor and also to locate stringers of a pallet so that they extend transversely of the path of movement of the conveyor on top of the bottom deck boards, feeding means in which top deck boards of a pallet can be located so that they extend longitudinally of the path of movement of the conveyor, the feeding means being operable to feed the top deck boards into position above a leading stringer which has been conveyed to the nailing station, and nailing means operable to nail the upper and the lower deck boards to stringers at the nailing station, operation of the conveyor to move the leading stringer away from the nailing station being effective to withdraw the upper deck boards from the feeding means so that they are located on the following stringers for nailing thereto.

BRIEF DESCRIPTION OF THE DRAWINGS

In the drawings:

FIG. 6 is a sectional view, taken longitudinally of the machine, through feeding means of the illustrative nailing machine;

DESCRIPTION OF PREFERRED EMBODIMENT OF THE INVENTION

Figure 1:
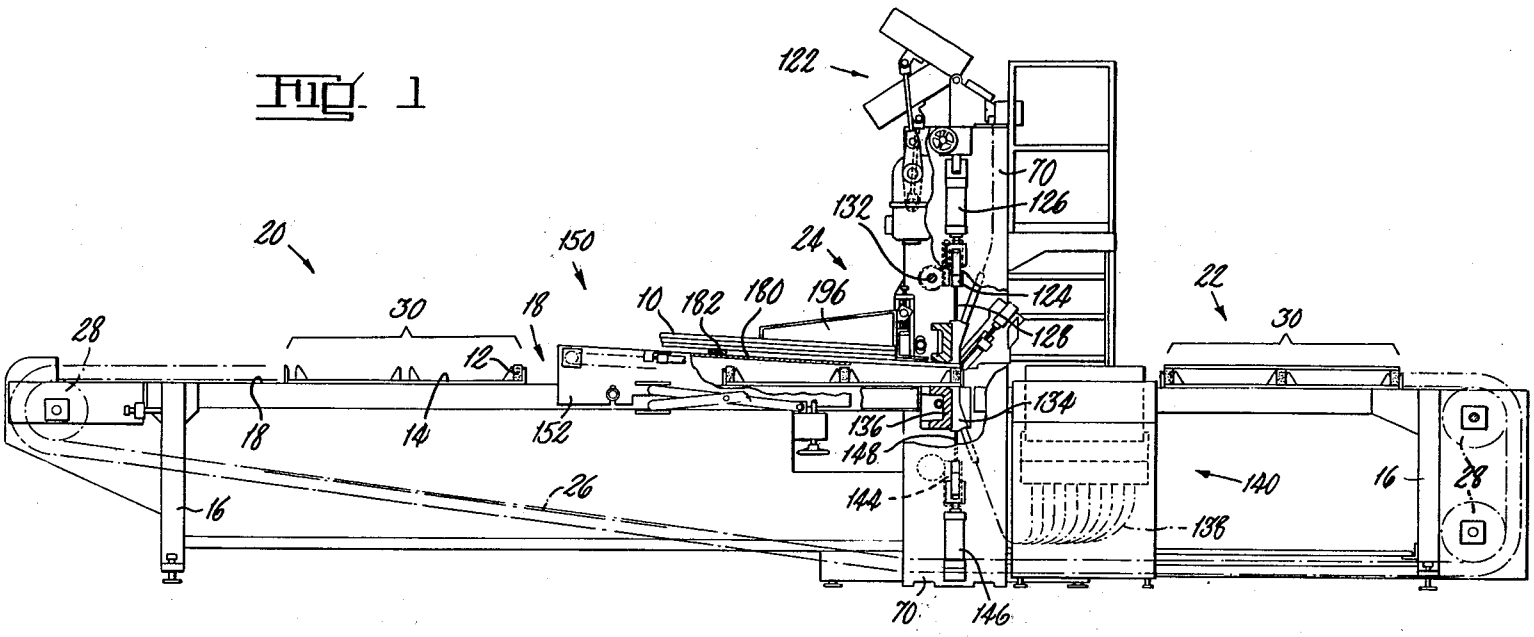
FIG. 1 is a side elevational view of the illustrative nailing machine.

The illustrative nailing machine shown in the drawings is for use in the manufacture of wooden pallets of the "American" type. This type of pallet comprises a top deck made up of deck boards extending parallel to one another, three stringers which extend parallel to one another transversely of the boards of the top deck and to which the top deck boards are nailed, and a bottom deck made up of deck boards which extend parallel to one another and to the top deck boards, the bottom deck boards being also nailed to the stringers. The particular "American" pallet that the illustrative nailing machine is arranged to manufacture has seven top deck boards 10, three stringers 12, and three bottom deck boards 14.

The illustrative nailing machine comprises a framework 16 (FIG. 1) which supports a table 18 which extends from a loading station 20 at a front end portion of the machine to an unloading station 22 at a rear end portion of the machine. Between the stations 20 and 22, the table 18 passes through a nailing station 24 of the machine.

The illustrative machine comprises a conveyor operable to convey pallet components, which are stringers 12 and bottom deck boards 14, located on the conveyor to the nailing station 24. The conveyor comprises two endless chains 26 which extend around an endless path longitudinally of the machine. The chains 26 mesh with sprockets 28 supported by the framework 16 at opposite end portions thereof and pass along the upper surface of the table 18 from the loading station 20 through the nailing station 24 to the unloading station 22. The conveyor also comprises a motor (not shown), arranged to drive the chains 26 around their endless path, and seven jigs 30 which are secured to the chains 26 for movement therewith around the endless path (three only of the seven jigs 30 are shown in FIG. 1).

Figure 4:
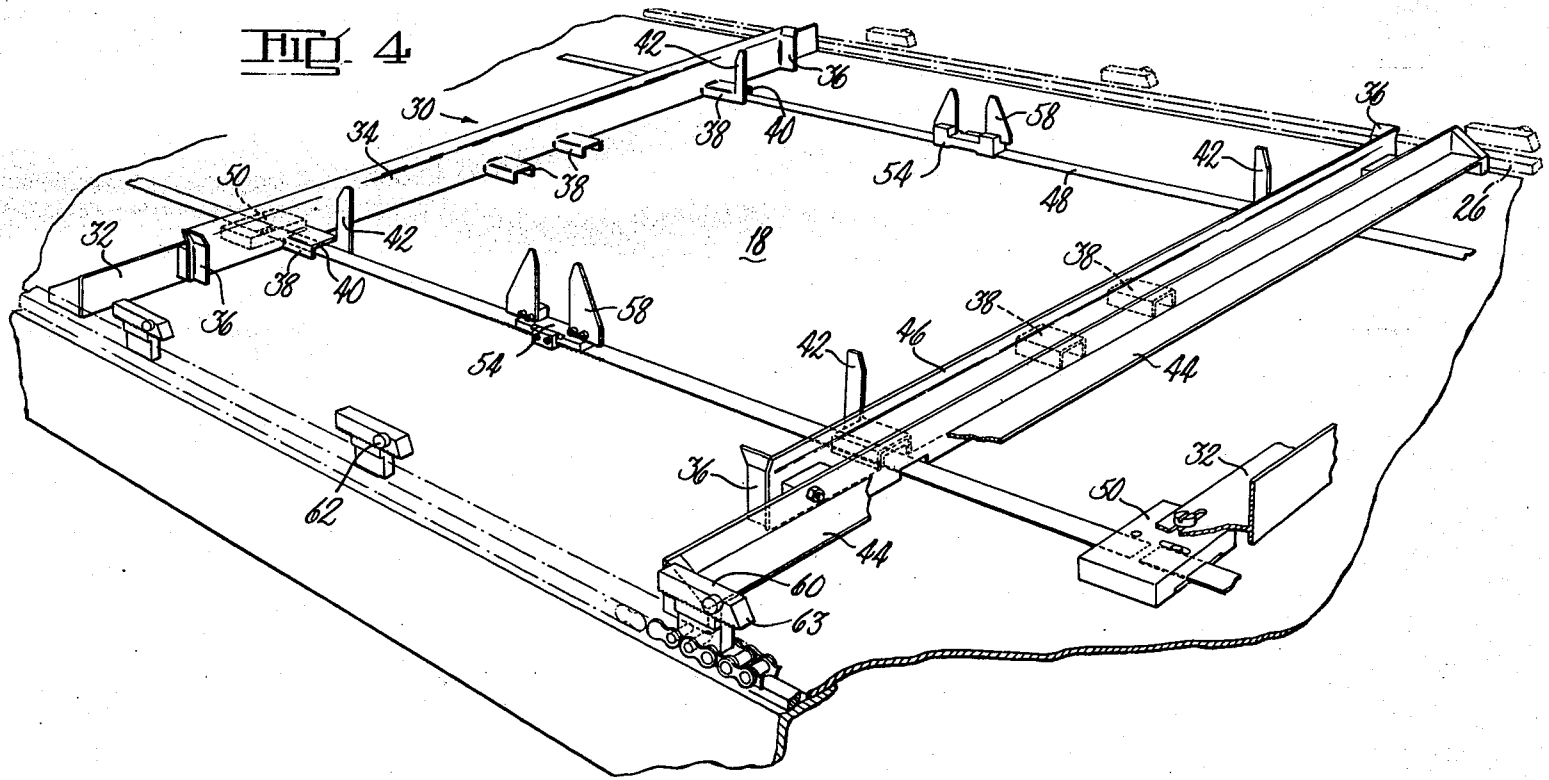
FIG. 4 is a perspective view of a locating jig of the illustrative nailing machine.

The construction of the jigs 30 appears from FIG. 4. Each jig 30 comprises a rearward rigid support strut 32 which is secured at its ends to the chains 26 and extends transversely across the table 18. The strut 32 has a rear locating member 34 bolted to a front edge thereof. The member 34 has two end location stops 36 projecting forwardly therefrom at opposite end portions of the member 34. The stops 36 extend upwardly above the table 18 to the height of a bottom deck board 14 with a stringer 12 on top of it. The member 34 also has four stops 38 projecting forwardly therefrom between the stops 36, the stops 38 extending upwardly above the table 18 to the height of a bottom deck board 14. The two stops 38 which are nearest to the stops 36 each have a channel 40 running longitudinally therethrough and carry an upstanding stop 42 which is spaced from the member 34 by the thickness of a stringer 12 and extends upwardly to the same height as the stops 36.

The jig 30 also comprises a forward rigid support strut 44 which is secured at its ends to the chains 26 forwardly of the strut 32 and extends transversely of the table 18. A front locating member 46 is bolted to a rear edge of the strut 44 and has identical stops 36, 38, and 42 projecting rearwardly therefrom to the stops of the member 34. The stops 36, 38 and 42 of the two location members 34 and 46 are aligned with one another.

Figure 5:
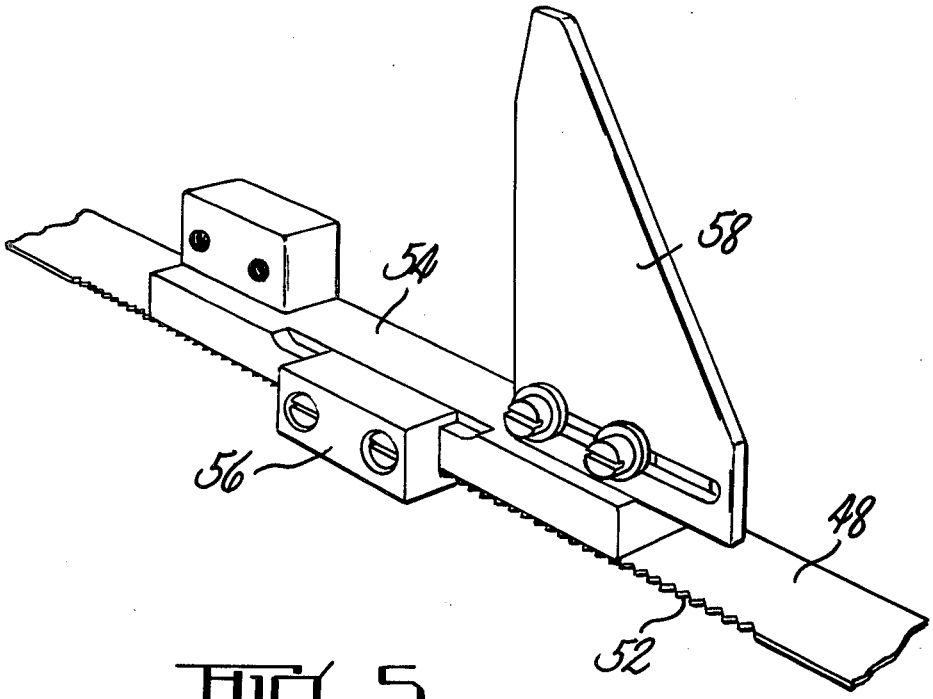
FIG. 5 is a detail perspective view of a portion of the locating jig shown in FIG. 4.
Figure 5:
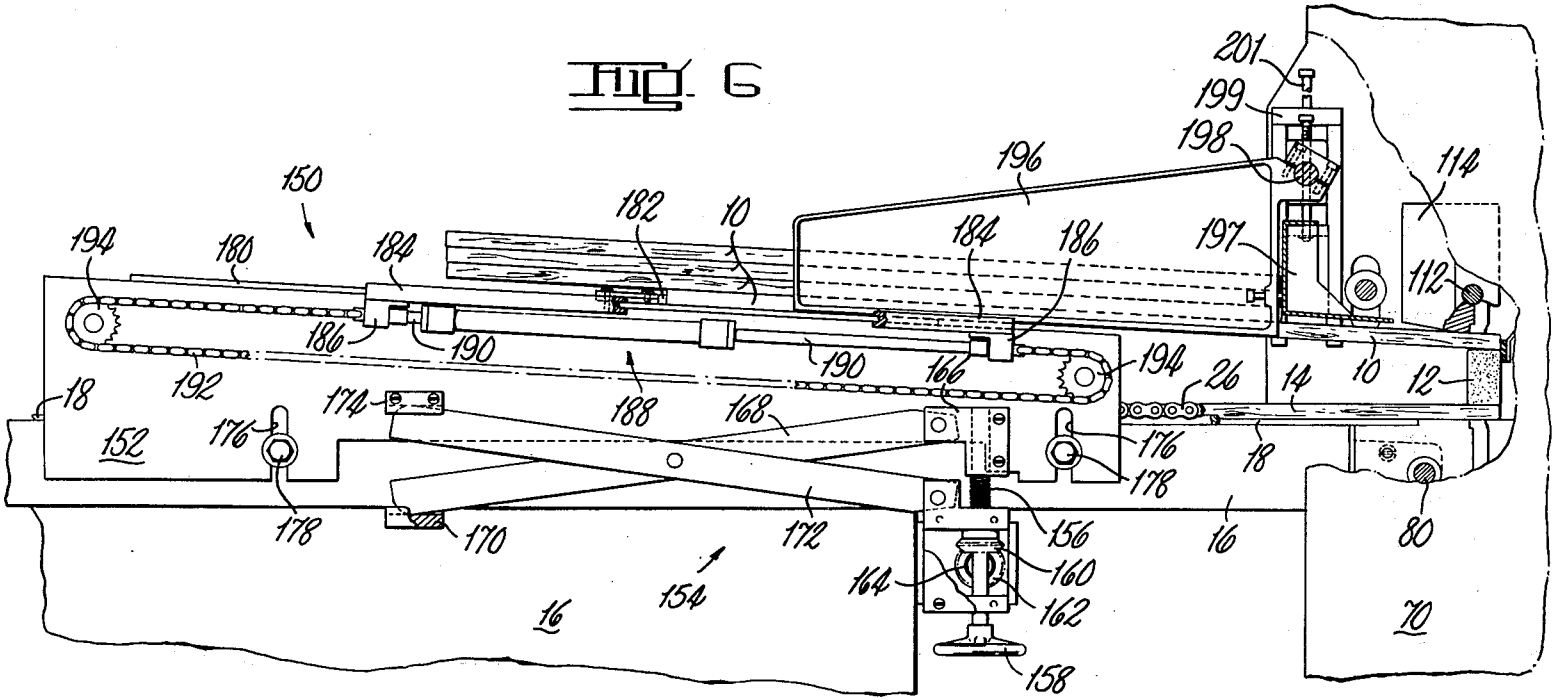

The jig 30 also comprises two flexible support members 48 which extend longitudinally of the machine along the table 18. The members 48 are made of spring steel which is sufficiently flexible to allow the members 48 to pass around the endless path of the conveyor. Rear end portions of the members 48 are secured to blocks 50 mounted on the support strut 32 and, from the blocks 50, the members 48 extend forwardly through the channels 40. The front end portions of the members 48 are secured to blocks 50 of the next jig ahead. Midway between the struts 32 and 44, each of the members 48 has a toothed portion 52 (see also FIG. 5). Mounted on the toothed portion 52 of each member 48 is a stop carrier 54 which is secured to the member 48 by means of a clamping member 56 which is screwed to the stop carriers 54. Each stop carrier 54 has legs (not shown) which slide on the table 18. Each carrier 54 carries two stops 58 which are separated, longitudinally of the machine, by the width of a stringer 12 and extend upwardly to the same height as the stops 36 and 42.

The jig 30 provides locating means arranged to locate stringers 12 so that they extend transversely of the path of movement of the conveyor and is also arranged to locate bottom deck boards 14 so that they extend longitudinally of the path of movement of the conveyor. In order to locate the stringers 12 and boards 14, the boards 14 are first located in the jig 30 so that they extend longitudinally of the machine. Two of the boards 14 are located between the members 34 and 46, the stops 36 and the stops 38. The other board 14 is located between the members 34 and 46 and the remaining stops 38. When the boards 14 have been located, the stringers 12 are located, one by the member 34 and the stops 36 and 42, a second by the member 46 and the stops 36 and 42, and the third by the stops 58. The stringers 12 then rest on top of the boards 14, the stops 38 and the stop carriers 54.

Figure 3:
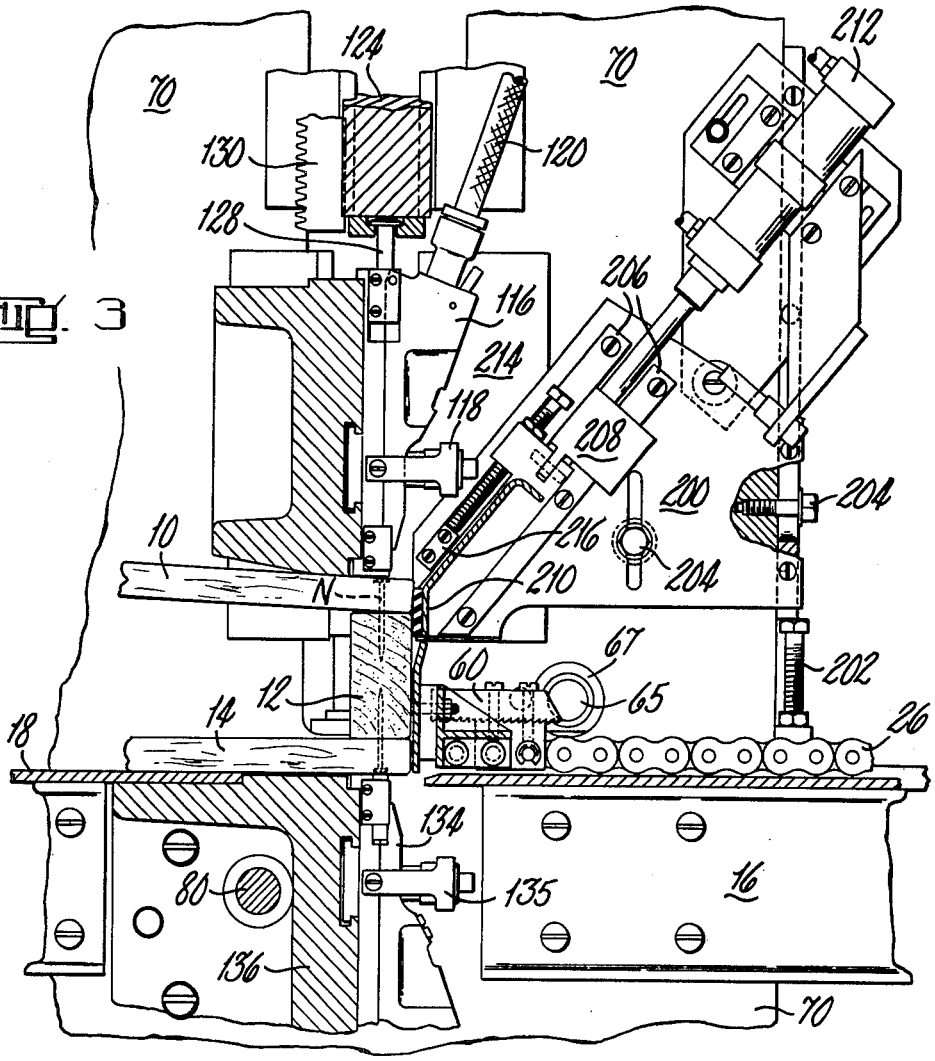
FIG. 3 is a sectional view, on a larger scale than FIG. 2, taken longitudinally of the machine through a nailing station of the illustrative nailing machine.
Figure 7:
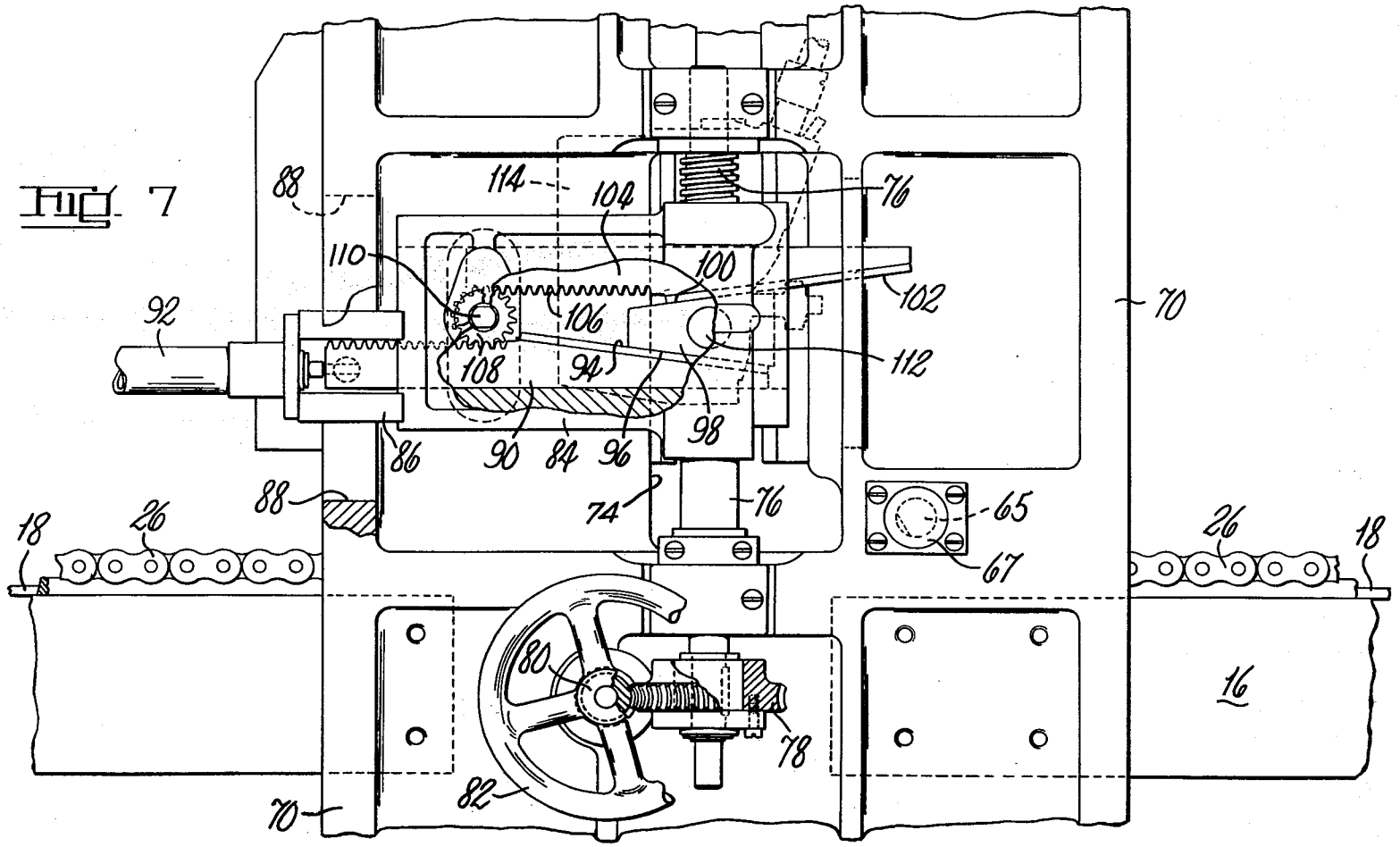
FIG. 7 is a side elevational view, partly in section, of the nailing station of the illustrative nailing machine.

The chains 26 each carry three limit stops 60 associated with each of the jigs 30. These stops 60 are adjustable longitudinally of the chains 26 and serve to bring the jig 30 to rest at desired positions at the nailing station 24. Each of the stops 60 carries a cam 62 which serves to operate a microswitch (not shown) which brings the conveyor to rest. In the operation of the conveyor, the cam 62 operates the microswitch causing the motor to stop driving the conveyor so that the conveyor comes to rest with forward surfaces 63 of two of the stops 60 engaging stops 65 (FIGS. 3 and 7). The stops 65 are carried by piston and cylinder assemblies 67 which are mounted on the framework 16 and operate to move the stops 65 into and out of the path of the stops 60.

The framework 16 of the illustrative nailing machine also comprises two support columns 70, one on each side of the table 18, at the nailing station 24. Each of the columns 70 has a vertically-extending slot 74 (FIG. 7) formed therein in each of which a vertically-extending screw 76 is mounted for rotation on the column 70. Each of the screws 76 carries a gear wheel 78 at a lower end thereof and the gear wheels 78 are meshed with screw-threaded portions of a shaft 80 supported by the columns 70 and which extends transversely between the columns 70 below the level of the table 18. The shaft 80 has a handle 82 mounted thereon by means of which the shaft 80 can be rotated. Rotation of the shaft 80, thus, causes the two screws 76 to rotate.

A beam support 84 (FIG. 7) is mounted on each of the screws 76 by the screw 76 being threadedly received in a screw-threaded bore therein. Each support 84 has a forward projection 86 which extends through a slot 88 in a rib of the support column 70, engagement of the projection 86 with the slot serving to prevent the support 84 from rotating about the screw 76. Thus, rotation of the handle 82 causes the screws 76 to be rotated and the supports 84 to move vertically.

Parts mounted on each of the supports 84 are identical and, therefore, only parts associated with the right hand support 84 will be described. A lower wedge 90 is mounted on the right hand support 84 for movement longitudinally of the machine by the action of a hydraulic piston and cylinder assembly 92 mounted on the projection 86. The wedge 90 has a sloping surface 94 which slopes downwards towards the unloading station 22 and which engages a lower sloping surface 96 of a wedge 98. An upper sloping surface 100 of the wedge 98 engages a sloping surface 102 of an upper wedge 104 which is also mounted on the support 84 for movement longitudinally of the machine. Each of the wedges 90 and 104 has a rack 106 formed thereon which racks mesh with a common cog wheel 108 fixedly mounted on a shaft 110 which extends transversely of the machine and is mounted for rotation on the two supports 84.

When the piston and cylinder assembly 92 operates to move the wedge 90, the racks 106 and the cog wheel 108 cause the upper wedge 104 to move in the opposite direction to that in which the wedge 90 moves. Furthermore, although both the supports 84 carry a piston and cylinder assembly 92, the shaft 110 ensures that the wedges 90 and 104 of the two supports 84 move together. If the lower wedge 90 is moved rearwardly (to the right in FIG. 7), the surface 94 presses the wedge 98 upwardly raising the wedge 98 on the support 84. If the lower wedge 90 is moved in the opposite direction, the surface 102 causes the wedge 98 to be moved downwards on the support 84. Thus, as the piston of the piston and cylinder assembly 92 moves through its stroke, the wedge 98 is moved up or down on the support 84. The wedge 98 receives in a hole therein a stub shaft 112 projecting from the end of a support beam 114 which is supported by the two wedges 98, extends transversely of the machine above the table 18 at the nailing station 24, and is movable vertically by operation of the piston and cylinder assemblies 92 which thus form moving means for the support beam 114. The piston and cylinder assemblies 92 are operable to move the beam 114 downwards so that the beam 114 clamps the deck boards 10 against a stringer 12 at the nailing station 24 before each nailing operation of nailing means of the illustrative machine (to be described) and, after each nailing operation, raises the beam 114 to enable further movement of the conveyor to take place. The piston and cylinder assemblies 92 are operable to move the beam 114 through a fixed stroke to clamp or release the deck boards 10 and stringer 12 and the position of this stroke is adjustable, to take account of differing thicknesses of pallet, by means of the handle 82 which moves the beam 114 and the piston and cylinder assemblies 92 vertically together.

The illustrative nailing machine also comprises nailing means comprising a first nailing mechanism which is operable to nail deck boards 10, supplied by feeding means (to be described), to stringers 12 at the nailing station 24 from above the stringers 12. The first nailing mechanism comprises upper hammer boxes 116 (FIG. 3) which are carried on the beam 114 above the nailing station 24. The hammer boxes 116 are held on the beam 114 by clamps 118 and each is arranged to position a nail N supplied through a pipe 120 by upper nail supply means 122 supported by the columns 70 (FIG. 1). The upper nail supply means 122 is of conventional construction and operates, after each operation of the first nailing means, to supply a nail to each of the hammer boxes 116.

The first nailing mechanism also comprises a hammer beam 124 which is slidable in the slots 74 above the beam 114. The beam 124 is supported on the pistons of two hydraulic piston and cylinder assemblies 126 (FIG. 1), one of which is mounted on each of the support columns 70. The beam 124 carries hammers 128 one of which projects downwardly into each of the hammer boxes 116. Adjacent each of the columns 70, the beam 124 has a vertically-extending rack 130 mounted thereon. The two racks 130 are each meshed with one of two cog wheels 132 fixedly mounted on a common shaft which extends transversely of the machine and is mounted for rotation on the columns 70. The racks 130 and the cog wheel 132 serve to keep the beam 124 horizontal by ensuring that its ends move through the same distance.

The operation of the first nailing mechanism is initiated by the supply of hydraulic fluid under pressure to the piston and cylinder assemblies 92 and 126. The assemblies 92 move the beam 114 downwards so that the hammer boxes 116 engage deck boards 10 at the nailing station 24 clamping them in position for nailing. The machine is shown in this condition in FIGS. 1 and 3. Next, the assemblies 126 move the beam 124 downwards causing the hammers 128 to move through the hammer boxes 116 engaging nails N therein and driving the nails through the boards 10 and into a stringer 12 from above. The operation of the first nailing means is completed by the reversal of the movements of the beams 114 and 124 by the operation of the assemblies 92 and 126 and the supply of further nails to the hammer boxes 116.

Figure 2:
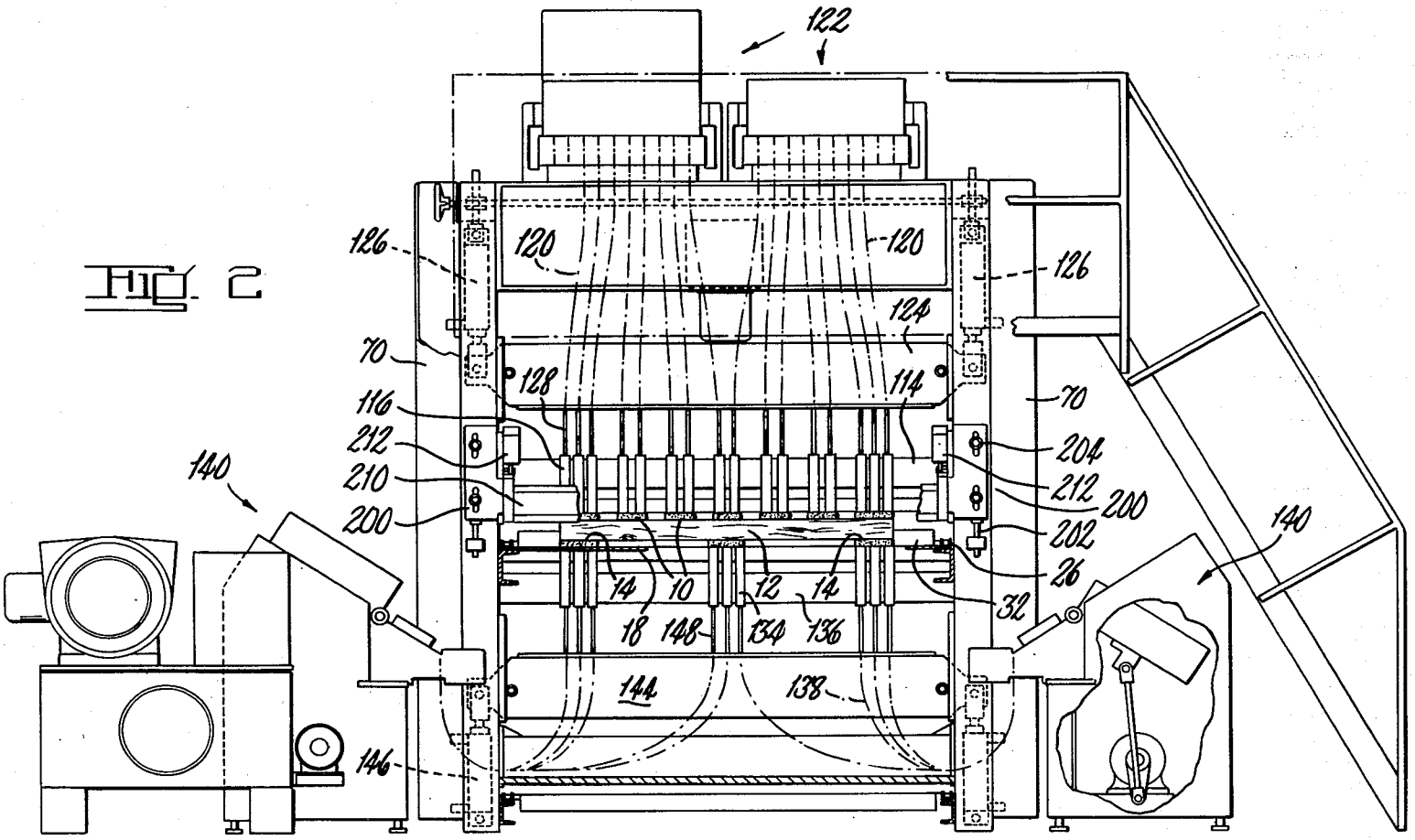
FIG. 2 is an end elevational view, on a larger scale than FIG. 1, of the illustrative nailing machine.
Figure 8:
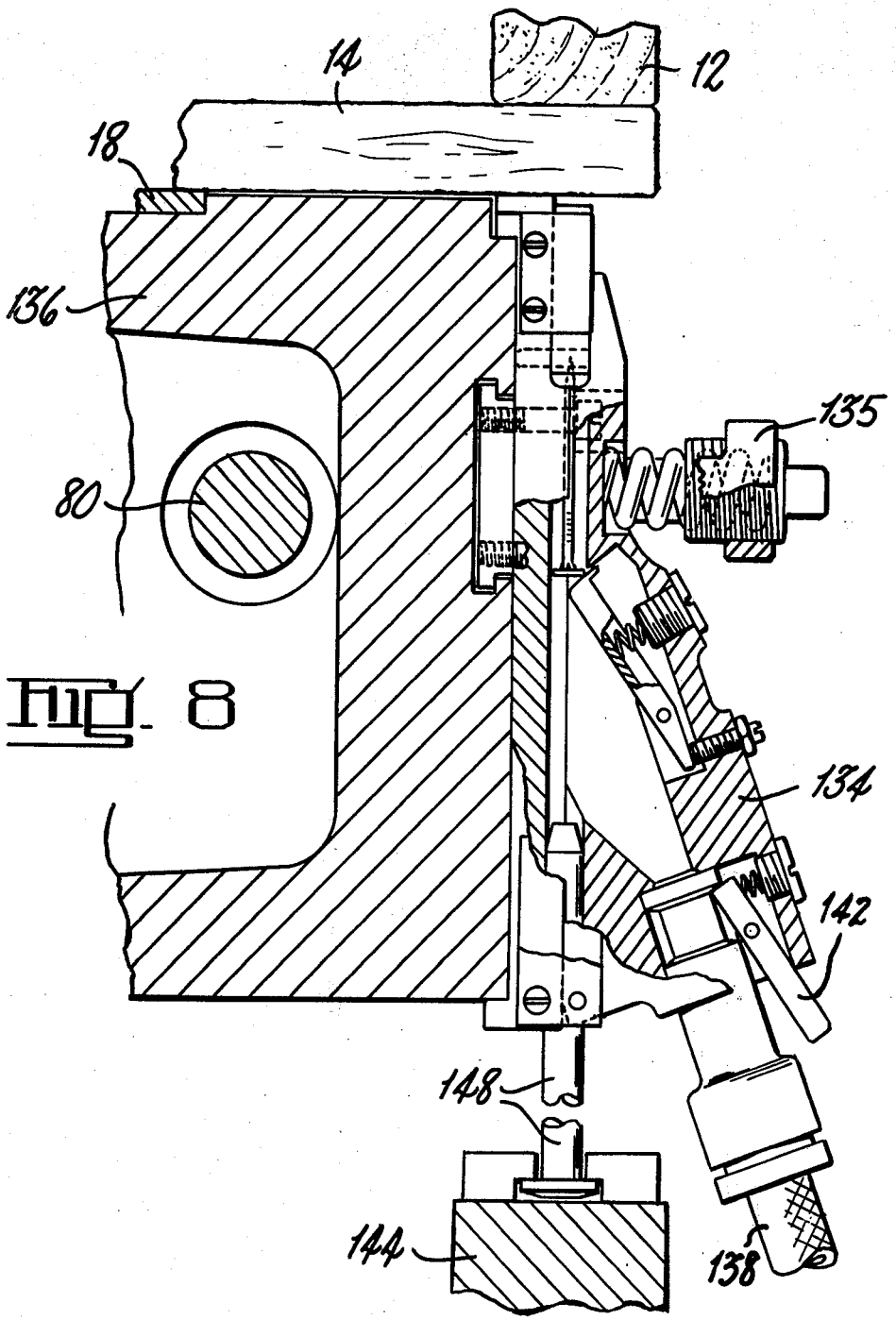
FIG. 8 is a sectional view of a lower hammer box of the illustrative nailing machine.

The illustrative nailing machine also comprises a second nailing mechanism operable to nail deck boards 14 located on a jig 30 of the conveyor to stringers 12 at the nailing station 24 from below the stringers 12. The second nailing means comprises lower hammer boxes 134 (FIGS. 2, 3 and 8) which are supported on a beam 136 in a gap in the table 18 at the nailing station 24 so that they are flush with the table 18. The lower hammer boxes 134 are positioned so that bottom deck boards 14 fed to the nailing station 24 by the conveyor are supported on the lower hammer boxes 134. The hammer boxes 134 are held by clamps 135 to the beam 136. Each of the hammer boxes 134 is arranged to position a nail N supplied thereto through a pipe 138 by lower nail supply means 140 which rests on the floor alongside the framework 16. The lower nail supply means 140 is of conventional construction except that it comprises means (not shown) for directing a blast of air under pressure through the pipes 138 so that the nails N are blown up to the hammer boxes 134. Each of the hammer boxes 134 comprises a spring clip 142 (FIG. 8) which yields to allow a nail N to enter the hammer box 134 and then springs back into place to provide support for the nail N when the blast of air ceases. The nail supply means 140 operates, after each operation of the second nailing mechanism, to supply a nail to each of the hammer boxes 134.

The second nailing mechanism also comprises a hammer beam 144 which is slidable on the columns 70 beneath the beam 136. The beam 144 is supported on the pistons of two hydraulic piston and cylinder assemblies 146 (FIG. 1), one of which is mounted on each of the support columns 70. The beam 144 carries hammers 148 one of which projects upwardly into each of the hammer boxes 134. The beam 144 carries racks similar to the racks 130 which are meshed with cog wheels similar to the wheels 132 which serve to keep the beam 144 horizontal.

The operation of the second nailing mechanism is initiated by the supply of hydraulic fluid under pressure to the piston and cylinder assemblies 146 which move the beam 144 upwards so that the hammers 148 move through the hammer boxes 134 engaging nails N therein. The nails N are driven through boards 14 and into a stringer 12 at the nailing station 24 from below. The operation of the second nailing mechanism is completed by the reversal of the movement of the beam 144 and the supply of further nails to the hammer boxes 134. The first and the second nailing mechanisms are arranged to operate simultaneously to nail a stringer 12 from above and below by simultaneous supply of hydraulic fluid under pressure to the assemblies 92, 126 and 146.

The feeding means (aforementioned) of the illustrative nailing machine, in which top deck boards 10 can be located so that they extend longitudinally of the path of movement of the conveyor, is operable to feed the top deck boards 10 into position above a leading stringer 12 which has been conveyed to the nailing station 24 by the conveyor. The feeding means comprises a framework 150 which straddles the table 18 and comprises two side plates 152 (FIG. 6) and cross members (not shown). The side plates 152 are supported, one on each side of the table 18 at a position between the loading station 20 and the nailing station 24, by jacks 154 mounted on the framework 16. Each of the jacks 154 comprises a screw-threaded shaft 156 which is mounted on the framework 16 to be rotated about a vertical axis by means of a handle 158. The shafts 156 each carry a bevel gear 160 which meshes with a bevel gear 162 fixedly mounted on a shaft 164 which is mounted for rotation on the framework 16 and extends transversely of the machine. The gears 160 and 162 and the shaft 164 ensure that the shafts 156 rotate together. An upper end portion of each of the shafts 156 is threadedly received in a bore in a bracket 166 which is mounted on the plate 152. A lever 168 of the jack 154 is pivotally mounted on the bracket 166 at an upper end portion thereof and a lower end portion of the lever 168 bears on a bearing block 170 mounted on the framework 16. At a central portion thereof, the lever 168 is pivotally connected to a lever 172 which has a lower end portion pivoted on the framework 16 and an upper end portion bearing on a bearing block 174 mounted on the plate 152. The jacks 154 form raising means operable to move the feeding means vertically relative to the conveyor to take account of differing thicknesses of pallet, since turning the handle 158 causes the shaft 156 to move the bracket 166 vertically relative to the framework 16 and the levers 168 and 172 to bring about similar movement of the block 174. The plate 152 has two vertically-extending slots 176 therein into which locking bolts 178 mounted on the framework 16 extend. The slots 176 provide guides for the vertical movement of the plate 152 and the locking bolts 178 allow the plates 152 to be locked in position.

The framework 150 supports an angled table 180 above the table 18 which is inclined at an angle of approximately 3° downwards towards the nailing station 24. Thus, the deck boards 10 are fed to the nailing station inclined downwardly and forwardly. The table 180 is arranged to support deck boards 10 to be fed to the nailing station 24. A pushing bar 182 extends across the table 180 transversely of the machine and is arranged to push boards 10 off the table 180 to the nailing station 24. The bar 182 is secured at each of its ends to a block 184 which is slidable along the edge of the table 180. Each of the blocks 184 has a bracket 186 depending from each of its end portions. A double-acting hydraulic piston and cylinder assembly 188 is mounted on each of the plates 152 between the two brackets 186 and has two piston rods 190 arranged to engage the brackets 186 to slide the block 184 and the pushing bar 182 towards or away from the nailing station 24. The two brackets 186 of each of the blocks 184 are connected to opposite ends of a chain 192 which passes around sprockets 194 fixedly mounted on shafts which extend transversely of the machine and are mounted for rotation on the plates 152. The sprockets 194 of each of the chains 192 are mounted on common shafts so that the chains 192 move together ensuring that the pushing bar 182 remains transverse of the machine.

Extending longitudinally of the machine above the table 180 are fourteen guide plates 196 (one shown in FIG. 6). These plates 196 extend rearwardly from a rail 198 supported by the columns 70 to which they are clamped. The plates 196 provide means whereby deck boards 10 on the table 180 can be located transversely of the machine. Also mounted on a rail 199 supported by the columns 70 is an upper limiting stop 197 which extends transversely of the machine rearwardly of the plates 196. The height of the stop 197 above the table 18 is adjustable by means of screws 201. The stop 197 acts to prevent more than one of a pile of boards 10 on the table 180 from being fed to the nailing station 24 by a single movement of the pushing bar 182.

Each of the columns 70 of the illustrative nailing machine has a plate 200 (FIG. 3) mounted thereon for vertical sliding movement. The plates 200 are above the table 18, can be adjusted heightwise of the column 70 by means of a setting screw 202 mounted on the framework 16, and can be locked in position of the column 70 by means of locking bolts 204. Each of the plates 200 has an inclined slideway 206 mounted thereon in which a block 208 is slidable towards and away from the nailing station 24. The two blocks 208 support between them a gate 210 which extends transversely of the machine and is arranged to be positioned at the nailing station 24 so that, when deck boards 10 from the feeding means engage the gate 210, they are positioned above a leading stringer 12 which has been conveyed to the nailing station 24.

Each of the blocks 208 is arranged to be moved in its slideway 206 by a hydraulic piston and cylinder assembly 212 mounted on the plate 200. The two assemblies 212 provide moving means operable to move the gate 210 out of the path of the deck boards 10 after the boards 10 have been nailed to the leading stringer 12, and subsequently back to the nailing station 24 to locate further boards 10. The position taken up by the gate 210 at the nailing station 24 can be adjusted by means of stop screws 214 mounted on the gate 210 and arranged to engage stops 216 mounted on the plates 200 thereby limiting the movement of the gate 210.

To set up the illustrative nailing machine for operation, an operator adjusts the height of the table 180 by turning one of the handles 158 to bring the table 180 to a height appropriate to the stringers 12 to be used. Also, he adjusts the position of the gate 210 by means of the stop screws 214 and the setting screws 202. He also adjusts the spacings of the plates 196 for the width of the boards 10 to be used, and the position of the stop 197 to the thickness of the boards 10. By turning the handle 82, the operator adjusts the position of the beam 114 to a height appropriate to the boards 10 and 14 and the stringers 12 to be used. Seven piles of boards 10 are placed on the table 180 in front of the pushing bar 182 and between the guide plates 196, each pile of boards 10 consisting of several boards 10 one above the other. Three boards 14 are located in a jig 30 at the loading station 20 and three stringers 12 are located in the jig 30 on top of the boards 14.

To operate the machine, the operator starts the conveyor which advances until the loaded jig 30 reaches the nailing station 24 where the cams 62 and the stops 60 and 65 bring it to rest. The cams 62 operating the microswitch cause the piston and cylinder assemblies 212 to move the gate 210 into position at the nailing station 24 (in which position it is shown in FIG. 3). Next, the piston and cylinder assemblies 188 operate moving the pushing bar 182 forwardly so that it engages rear edges of the seven boards 10 on the table 180 which are lowermost in the piles of boards 10 and pushes these seven boards 10 forwardly, under the stop 197, until they engage the gate 210 when they are located in position above the leading stringer 12 in the jig 30 at the nailing station 24.

Next, in the operation of the illustrative nailing machine, the piston and cylinder assemblies 92 operate moving the beam 114 downwards towards the table 18 so that the hammer boxes 116 engage the boards 10 which are in engagement with the gate 210 and clamp the boards 10, the leading stringer 12 and the boards 14 against the beam 136. Next, the piston and cylinder assemblies 126 and 146 operate moving the beam 124 downwards and the beam 144 upwards simultaneously so that the hammers 128 drive nails from the hammer boxes 116 through the boards 10 and into the leading stringer 12 and the hammers 148 drive nails from the hammer boxes 134 upwards through the boards 14 and into the leading stringer 12.

Next, in the operation of the illustrative nailing machine, the piston and cylinder assemblies 126, 92, 146 and 212 reverse their operations moving the beams 124 and 114 upwards, the beam 144 downwards and moving the gate 210 out of the path of the deck boards 10. The piston and cylinder assemblies 67 withdraw the stops 65 from the path of the stops 60 and the conveyor moves on. After the leading stops 60 have passed the stops 65, the piston and cylinder assemblies 67 again move the stops 65 into the path of the stops 60. The nail supply means 122 and 140 also operate supplying further nails to the hammer boxes 116 and 134. As the conveyor moves on, the deck boards 10 which have already been nailed to the leading stringer 12 are withdrawn from the feeding means, since they are nailed to the leading stringer 12, and are positioned on the following stringers 12 for nailing thereto. The boards 10 are, at this time, still being located transversely of the machine by the plates 196. When the second stringer 12 arrives at the nailing station 24, the cams 62 and the stops 65 again bring the conveyor to rest, whereupon the first and the second nailing means operate simultaneously nailing the boards 10 and 14 to the second stringer 12. A further movement of the conveyor brings the third stringer 12 to the nailing station 24 where the boards 10 and 14 are also nailed to it. The jig 30 then carries the completed pallet to the unloading station 22 where it is removed from the jig 30.

Although the illustrative machine is described as operating with the top deck boards 10 being fed by the feeding means and the bottom deck boards 14 being located on the conveyor, it is to be understood that, if desired, the pallet can be constructed upside-down with the bottom deck boards 14 being fed by the feeding means and the top deck boards 10 being located on the conveyor.

Having thus described our invention, what we claim as new and desire to secure by Letters Patent of the United States is:

1. A nailing machine for use in the manufacture of wooden pallets comprising a conveyor operable to convey pallet components located thereon to a nailing station of the machine, the conveyor comprising locating means arranged to locate stringers of a pallet so that they extend transversely of the path of movement of the conveyor and arranged to locate bottom deck boards of a pallet so that they extend longitudinally of the path of movement of the conveyor beneath the stringers located by the locating means, feeding means in which deck boards of a pallet can be located so that they extend longitudinally of the path of movement of the conveyor, the feeding means being operable to feed deck boards of a pallet into position above a leading stringer which has been conveyed to the nailing station, and nailing means comprising a first nailing mechanism operable to nail the deck boards fed by the feeding means to a stringer from above the stringer and a second nailing mechanism operable to nail the bottom deck boards located by the locating means to a stringer from below the stringer, operation of the conveyor to move the leading stringer away from the nailing station being effective to withdraw the deck boards from the feeding means so that they are located on the following stringers for nailing thereto.

2. A nailing machine according to claim 1 wherein the machine comprises raising means operable to move the feeding means vertically relative to the conveyor.

3. A nailing machine according to claim 1 wherein the feeding means is arranged to feed the deck boards to the nailing station inclined downwardly and forwardly at an angle of approximately 3° .

4. A nailing machine for use in the manufacture of wooden pallets comprising a conveyor operable to convey pallet components located thereon to a nailing station of the machine, the conveyor comprising locating means arranged to locate bottom deck boards of a pallet so that they extend longitudinally of the path of movement of the conveyor and also to locate stringers of a pallet so that they extend transversely of the path of movement of the conveyor on top of the bottom deck boards, feeding means in which top deck boards of a pallet can be located so that they extend longitudinally of the path of movement of the conveyor, the feeding means being operable to feed the top deck boards into position above a leading stringer which has been conveyed to the nailing station, and nailing means operable to nail the upper and the lower deck boards to stringers at the nailing station, operation of the conveyor to move the leading stringer away from the nailing station being effective to withdraw the upper deck boards from the feeding means so that they are located on the following stringers for nailing thereto.

5. A nailing machine according to claim 4 wherein the nailing means is arranged to nail deck boards to a stringer from above and below simultaneously.

6. A nailing machine according to claim 5 wherein the nailing means comprises lower hammer boxes positioned at the nailing station so that bottom deck boards fed to the nailing station by the conveyor are supported on the lower hammer boxes, the lower hammer boxes being supplied with nails through pipes through which nails are blown by air under pressure.

7. A nailing machine according to claim 4 also comprising a beam at the nailing station and movable vertically by moving means therefor, the moving means being operable to move the beam downwards so that the beam clamps the deck boards against a stringer at the nailing station before each nailing operation of the nailing means, and, after each nailing operation, raises the beam to enable further movement of the conveyor to take place.

8. A nailing machine according to claim 7 wherein the moving means is operable to move the beam through a fixed stroke.

9. A nailing machine according to claim 8 wherein the beam and the moving means are movable vertically together.

10. A nailing machine according to claim 9 wherein the beam carries hammer boxes of the nailing means.

* * * * *